US009005370B2

(12) United States Patent
Bühlmeyer et al.

(10) Patent No.: US 9,005,370 B2
(45) Date of Patent: Apr. 14, 2015

(54) WATER-CONDUCTING HOUSEHOLD APPLIANCE HAVING A TREATMENT CONTAINER ASSEMBLED FROM AT LEAST TWO COMPONENTS

(75) Inventors: Alexander Bühlmeyer, Bopfingen (DE); Werner Haltmayer, Dinkelsbühl (DE); Cengiz Kücük, Syrgenstein (DE); Manfred Seeβle, Gerstetten (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1211 days.

(21) Appl. No.: 12/515,313

(22) PCT Filed: Nov. 7, 2007

(86) PCT No.: PCT/EP2007/061960

§ 371 (c)(1),
(2), (4) Date: Nov. 25, 2009

(87) PCT Pub. No.: WO2008/061878

PCT Pub. Date: May 29, 2008

(65) Prior Publication Data

US 2010/0132749 A1 Jun. 3, 2010

(30) Foreign Application Priority Data

Nov. 23, 2006 (DE) ..... 10 2006 055 347

(51) Int. Cl.
*A47L 15/42* (2006.01)
*D06F 39/12* (2006.01)

(52) U.S. Cl.
CPC ..... *D06F 39/12* (2013.01); *A47L 15/4246* (2013.01)

(58) Field of Classification Search
USPC ..... 134/56 D
See application file for complete search history.

(56) References Cited

U.S. PATENT DOCUMENTS

| | | | | |
|---|---|---|---|---|
| 3,213,583 | A * | 10/1965 | Winski et al. | 52/395 |
| 3,545,147 | A | 12/1970 | Eastham et al. | |
| 3,864,814 | A | 2/1975 | Bagge | |
| 2005/0017609 | A1 * | 1/2005 | Kucuk et al. | 312/228 |

(Continued)

FOREIGN PATENT DOCUMENTS

| | | | | |
|---|---|---|---|---|
| DE | 812130 | | 7/1949 | |
| DE | 3636437 | A1 * | 5/1988 | A47L 15/42 |

(Continued)

OTHER PUBLICATIONS

English machine translation of JP08-155564.*

*Primary Examiner* — Michael Kornakov
*Assistant Examiner* — Jason Riggleman
(74) *Attorney, Agent, or Firm* — James E. Howard; Andre Pallapies

(57) ABSTRACT

A water-conducting household appliance including a treatment container defining an interior of the water-conducting household appliance, the treatment container including at least two components made of different materials, wherein each of the at least two components include an edge section at which a mechanical connection is formed between the at least two components, wherein the mechanical connection is formed in a section protected against moisture, and a seal element that seals the mechanical connection on a side facing the interior of the water-conducting household appliance such that a gap exposed to moisture is formed which is free of a capillary gap.

7 Claims, 2 Drawing Sheets

(56) References Cited

U.S. PATENT DOCUMENTS

| | | | |
|---|---|---|---|
| 2006/0054195 | A1 | 3/2006 | Yoon et al. |
| 2009/0095335 | A1 | 4/2009 | Buehlmeyer et al. |
| 2009/0126765 | A1 | 5/2009 | Buehlmeyer et al. |

FOREIGN PATENT DOCUMENTS

| | | | | | |
|---|---|---|---|---|---|
| DE | 3636437 | A1 | | 5/1988 | |
| DE | 4017748 | A1 | | 12/1991 | |
| DE | 4017748 | A1 | * | 12/1991 | ..... D21D 39/02 |
| EP | 0556787 | A1 | | 8/1993 | |
| ES | 483274 | A1 | | 4/1980 | |
| FR | 2396603 | | * | 2/1979 | ..... A47L 15/42 |
| JP | 08-155564 | | * | 6/1996 | ..... B21D 39/002 |
| JP | 08155564 | | | 6/1996 | |
| JP | 2002239755 | A | | 8/2002 | |
| WO | 2006010743 | A1 | | 2/2006 | |

* cited by examiner

WATER-CONDUCTING HOUSEHOLD APPLIANCE HAVING A TREATMENT CONTAINER ASSEMBLED FROM AT LEAST TWO COMPONENTS

The invention relates to a water-conducting household appliance, in particular a dishwasher, with a treatment container which is composed of at least two components made of different materials.

BACKGROUND OF THE INVENTION

The treatment container in dishwashers is usually made of stainless steel. The treatment container frequently consists of at least two components. The so-called container case forms the side walls and the top of a container hood of the treatment container and is connected for example with a separately formed rear wall which is likewise a constituent part of the container hood. This assembly is then connected with a dishwasher tub. For reasons of corrosion resistance the components of the treatment container are made of high-quality chromium-nickel (Cr—Ni) steel, which is relatively expensive. The use of chromium-nickel steel ensures that corrosion resistance is guaranteed also in areas where there is a mechanical connection between the container case and the rear wall, which usually takes the form of a weld seam.

From the production point of view it would be preferable if significant parts of the treatment container could be made of the simpler chromium (Cr) steel because this would reduce the costs of manufacture. The problem that exists with connecting chromium steel with chromium-nickel steel by welding is that crevice corrosion can arise in the area of the weld in water-conducting household appliances such as dishwashers. Crevice corrosion can also arise if the entire container hood is made of a chromium-steel assembly.

To avoid crevice corrosion special connection technologies are therefore needed to join together the two components of the treatment container of the water-conducting household appliance.

From FR 2 396 603 a treatment container is known for a dishwasher in which the container top and the container bottom tub are in each case connected with the side walls by means of a fold with an inserted seal. The sealing effect, i.e. the sealing of a gap between the two components, is achieved by a squeezing action. It is questionable here whether the seal element can be pressed in the direction of the interior of the treatment container as shown in the figures. It is further questionable whether the seal element in the way shown in the figures is not squeezed out by the squeezing action where the components meet. It is further doubtful whether the seal element on the side facing the interior of the dishwasher fits intimately on the component walls so that the desired seal is actually achieved.

From U.S. Pat. No. 3,545,147 and U.S. Pat. No. 3,213,583 connection technologies are known for caravan roofs. In FIG. 7 the connection technology is shown in more detail, showing the mechanical connection produced using a separate holding element which exhibits an independent mechanical connection with the edge sections of the components to be joined together. Unlike the joining method used for a treatment container of a water-conducting household appliance, however, the holding elements are not located on the side which is protected against moisture.

Various connection technologies using a separate holding element to join together two mechanically separate components are also known from DE 812 130. None of the connection technologies presented and described in the figures are, however, suitable for use in water-conducting household appliances.

From JP 08155564 a method is also known for joining together two metallic components in which the mechanical connection is made by means of laser welding. Furthermore, a seal element is provided in a section of the connection which is different from the welded area.

In JP 2002239755 A a watertight connection is proposed by intermeshing folded-over edge sections of two components. Because no separate seal element is provided, however, the connection shown would be susceptible to crevice corrosion if used in a water-conducting household appliance.

SUMMARY OF THE INVENTION

The object of the invention is therefore to provide a water-conducting household appliance with a treatment container composed of at least two components in which crevice corrosion can be reliably prevented in the area where the two components are mechanically joined together.

This object is achieved by a water-conducting household appliance with the features of the exemplary embodiments described herein.

In the inventive water-conducting household appliance each of the components exhibits an edge section by which a mechanical connection of the two components is effected, whereby the mechanical connection is made in a section which is protected against moisture. The mechanical connection is sealed by means of a seal element on the side of the treatment container facing the interior of the dishwasher, so that a gap between the components which would be exposed to moisture and exhibit a capillary effect is avoided, i.e. a design which does not have a capillary gap is achieved. As the treatment container is to be produced using at least two components of different materials which exhibit different properties in particular with regard to their corrosion resistance, special attention must be paid to the type of seal and the associated connection technology. As the risk of corrosion is created in particular by the formation of a gap and the associated capillary effects, it is provided that the seal element is arranged on the side of the treatment container facing the interior of the dishwasher in such a way that a gap exhibiting a capillary effect is reliably avoided between the components.

The two components to be joined together can for example be the container top and the side walls and/or the side walls and the dishwasher tub and/or the side walls and the rear wall and/or two-piece side walls and the like.

In accordance with a configuration of the invention the mechanical connection can be formed by a welded connection, a bonded connection, a folded connection, a clamped connection or a beaded connection. The key factor here is that the mechanical connection of the two components is made in a section which is protected against moisture. The seal element must therefore be located in an area in front of the mechanical connection.

In one configuration the mechanical connection can be formed in an area where the edge sections of the components to be joined together overlap. This connection technology makes for particularly easy manufacture as for example a welded or a bonded connection can be used. In another configuration the mechanical connection is made by using a holding element which exhibits an independent mechanical connection with the edge sections of the components to be joined together. The mechanical connection of the holding element to the edge sections of the components being joined together can be made by means of a welded or bonded connection or preferably by a purely mechanical connection in the form of a folded, clamped or beaded connection. Compared with the first-mentioned variant this connection technology has the advantage that the interior of the treatment container which is visible to the user largely features a smooth surface. The connection between the components is noticeable merely from the visible seal element for sealing a gap between the components which would exhibit a capillary effect. On the other hand, the second variant possibly requires a greater depth than the first-mentioned variant, so that the exterior housing of the water-conducting appliance exhibits a greater distance from the treatment container.

It is particularly preferable if the seal element is clamped between the first and the second component through the application of force, so that the seal element fits intimately on the opposite surfaces of the components. The force is applied by the mechanical connection of the first and second component. The clamping action ensures that the seal element cannot be squeezed out when the mechanical connection is made between the first and the second component, so that the seal element fits intimately on the opposite surfaces of the components. As a result, a gap which would exhibit a capillary effect can be reliably avoided.

In accordance with a further configuration it may be provided that the seal element is arranged in a recess of the first and/or second component adapted to its cross-section. This makes manufacture particularly easy as the seat of the seal element is determined from the outset by the shape of the component or components. Also, an improved optical impression for the user of the water-conducting household appliance can be ensured by recessing a part of the seal element.

In a further configuration of the invention the mechanical connection of the first and the second component takes place in the area of orthogonally meeting surfaces of the components, whereby the seal element is arranged in a corner area and the seal element is enclosed, at least partially, preferably intimately, by the first and the second component in the direction of the side of the corner facing away from the dishwasher interior. This special connection technology e.g. between the top of the container and the side walls or the top of the container and the rear wall of the treatment container makes for an optically particularly homogeneous impression, particularly easy assembly and particularly good protection against crevice corrosion.

A further configuration provides that the overlap of the edge sections of the first and the second component runs horizontally in the area of the side walls and the overlap of the edge sections is such that the edge section of the component running in the direction of the container top faces the dishwasher interior and the edge section of the component running in the direction of the container bottom faces the dishwasher exterior, so that the seal element arranged between the edge sections is oriented in the direction of the bottom tub. Because the dishwasher liquid runs in the direction of the dishwasher tub the seal element does not have to perform any actual seal function in respect of the dishwasher liquid. It primarily has to counter any capillary forces, which is particularly easy as the seal is placed in an area which is protected against moisture.

A further configuration provides that the seal fits tightly on a fold formed on the edge section. This ensures that e.g. end surfaces of the components caused by stamping or cutting which are particularly susceptible to corrosion do not face the interior of the dishwasher. As a result, improved corrosion protection is provided. In addition, it is ensured that there are no sharp edges in the dishwasher interior accessible to the user.

BRIEF DESCRIPTION OF THE DRAWINGS

The invention is explained in more detail below with reference to figures.

DETAILED DESCRIPTION OF THE EXEMPLARY EMBODIMENTS OF THE PRESENT INVENTION

Figure 1:
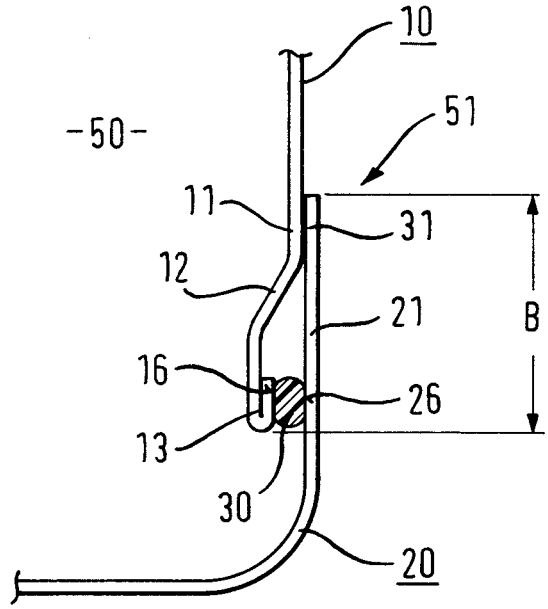
FIG. 1 shows a first exemplary embodiment of a mechanical connection of two components of a treatment container in a water-conducting household appliance in which the mechanical connection is formed in an area of overlapping edge sections of the components to be joined together.

In FIG. 1 a detail of a treatment container of a water-conducting household appliance is shown. A component 10, which for example represents a side wall of the treatment container, is made of a simple chromium steel and is connected with a second component 20, a dishwasher tub made for example of chromium-nickel steel or plastic. The dishwasher interior of the treatment container is indicated by the reference number 50.

The first component 10 exhibits an edge section 11 and the second component 20 exhibits an edge section 21. In the area of these edge sections 11, 21 the two components overlap, which is indicated by the arrow with the reference letter B. The mechanical connection of the two components 10, 20 is made in this overlap area B, in a section protected against moisture. The connection at the point indicated by the reference number 31 can for example be made by means of a welded or bonded connection.

In the area facing downwards to component 20 the component 10 has a fold 13. Between the surface formed by the fold 13 and an opposite surface 26 in the edge section 21 of the component 20 a seal element 30, e.g. made of rubber or plastic, is clamped in. The seal element, which fits intimately on the surfaces 16, 26, prevents any liquid from penetrating in the direction of the mechanical connection point (reference number 31). In addition, the seal element prevents a direct adjoining of the components 10, 20 which are made of differently corrosion-resistant materials. If the components 10, 20 were directly connected with each other mechanically in the area of the seal element 30 and there were no further sealing measures on the side facing the container interior 50 a gap would form into which dishwasher liquid could penetrate as a result of the capillary effect. Over time rust could then form, especially in the less corrosion-resistant material, which would adversely affect the appearance of the dishwasher interior and also the functional capability of the machine.

The provision of the seal element 30 at the point shown in the figure prevents the formation of a gap between the two components 10, 20 and effectively prevents crevice corrosion. As a result, the otherwise unfavorable joining method of welding can also be used between chromium steel and chromium-nickel steel. As the seal element is arranged so that it is protected against direct spray water from the dishwasher liquid, there is no risk of moisture penetrating into the gap between the two components 10, 20, which means that the mechanical connection 31 is not exposed to moisture problems.

In the exemplary embodiment shown in FIG. 1 the component 10 features a bend 12 which extends the edge section 11 in the direction of the dishwasher interior 50. Just as conceivable would be an arrangement in which the component 10 runs straight down in the area of the overlap B and the component 20 features a bend, which in the figure runs to the left.

Figure 2:
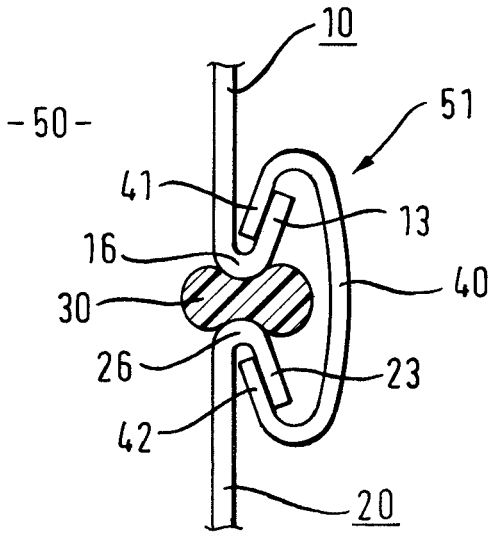
FIG. 2 shows a second exemplary embodiment of a mechanical connection of two components of a treatment container in a water-conducting domestic household appliance in which the mechanical connection is made using a holding element.

FIG. 2 shows a further exemplary embodiment of a connection of the two components 10, 20 which, as in the previously described exemplary embodiment, consist of two different materials. Each of the components 10, 20 exhibits a fold 13, 23, in which the ends 41, 42 of a holding element 40 engage. The holding element 40 is arranged on the side of the treatment container facing away from the dishwasher interior 50. As a result, the area susceptible to corrosion between the fold 13 and the end 41 of the holding element 40 and between the fold 23 and the end 42 of the holding element 40 is reliably protected against moisture. The mechanical connection between the ends 41, 42 and the folded ends 13, 23 of the components 10, 20 can be made by a clamped, bonded or welded connection. For sealing the mechanical connections a seal element 30 is provided which is clamped in between the turned-over ends of the folds (surfaces 16, 26). The force applied by the holding element to connect the components 10, 20 and thus to clamp in and deform the seal element 30 is just strong enough so that the seal element 30 contacts intimately with the surfaces 16, 26 but is not strong enough to squeeze out or shear off the seal element. The seal element made of rubber or plastic or natural rubber or other suitable material can in its original cross-section be round or ellipsoidal or already feature constrictions.

Figure 3:
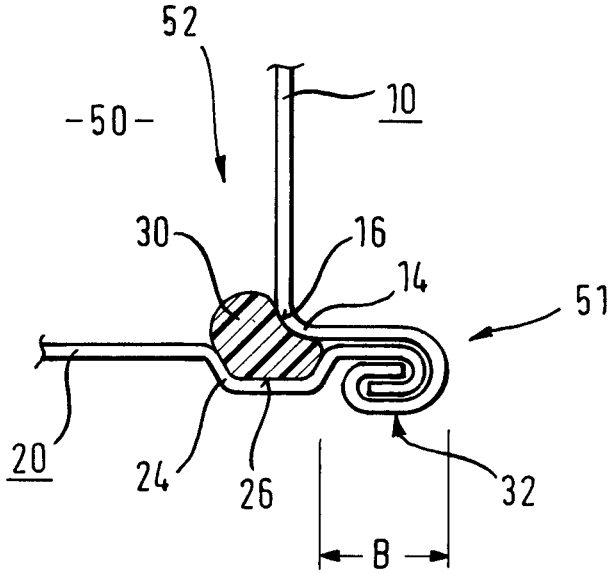
FIG. 3 shows a third exemplary embodiment of a mechanical connection of two components of a treatment container in a water-conducting household appliance in which the mechanical connection of the two components is made in an area of orthogonally meeting surfaces in a corner area.

A further exemplary embodiment is shown in FIG. 3. The connection of the first component 10 and of the second component 20 is made in a corner area 52 of the treatment container. The seal element 30 is therefore located on the corner facing the dishwasher interior 50, e.g. between the container wall and container top or container wall and dishwasher tub. The second component 20 is for example provided with a recess 24 which is adapted to the cross-sectional shape of the seal element 30. The seal element 30 is inserted in the recess 24 and fits intimately on the wall of the recess 24 (reference number 26). In the exemplary embodiment the component 10 is mechanically connected with the component 20 by means of a beaded connection 32. Other connection technologies could also be used, e.g. a bonded, welded, folded or other connection. In the corner area, and in particular in the area of the seal element 30, the component 10 is L-shaped, which causes the component section 14 to deform the seal element 30, effecting an intimate connection of the surface 16 with the seal element 30. This design reliably prevents moisture or dishwasher liquid from penetrating from the dishwasher interior 50 in the direction of the mechanical fastening, and thereby prevents crevice corrosion from occurring in the overlap area B.

In addition to the connection technologies described in the exemplary embodiments, further connection technologies come into consideration which ensure that the components to be joined together in the area of the dishwasher interior do not exhibit any direct contact with each other but are connected with each other via a seal element. A feature common to all the exemplary embodiments described is that the mechanical connection is located in a moisture-free area. This means that in an area protected against moisture by the seal element a mechanical connection can be made using any desired connection technology irrespective of whether this is in principle suitable for moist environments or not.

| List of reference characters | |
|---|---|
| 10 | Component |
| 11 | Edge section |
| 12 | Bend |
| 13 | Fold |
| 14 | Component section |
| 16 | Surface |
| 20 | Component |
| 21 | Edge section |
| 23 | Fold |
| 24 | Recess |
| 26 | Surface |
| 30 | Seal element |
| 31 | Connection point |
| 32 | Flange |
| 41 | Holder element end |
| 42 | Holder element end |
| 50 | Dishwasher interior |
| 51 | Moisture-free area |
| 52 | Corner area |
| B | Overlap area |

The invention claimed is:

1. A water-conducting household appliance comprising:

a treatment container, the treatment container including:

at least two components having different corrosion properties, wherein each of the at least two components include an edge section at which a mechanical connection is formed between the at least two components, wherein the mechanical connection is formed in a section protected against moisture; and a seal element on an interior side of the treatment container that seals the mechanical connection on the interior side of the treatment container such that a gap exposed to moisture is formed which is free of a capillary gap, wherein the mechanical connection is formed in a region of surfaces of the at least two components impinging substantially orthogonally on one another, and wherein the seal element is arranged in a corner region of the treatment container, the corner region disposed at a wall of the treatment container joining at least one of a top of the treatment container and a tub of the household appliance, and the sealing element is at least partly surrounded by the first and second components in a direction remote from a rinsing chamber interior of the household appliance.

2. The household appliance as claimed in claim 1, wherein the at least two components being joined together are made of one of chromium steel, chromium-nickel steel, and plastic.

3. The household appliance as claimed in claim 1, wherein the water-conducting household appliance is a dishwasher.

4. A water-conducting household appliance comprising:

a treatment container, the treatment container including:

a first component having a first edge section;

a second component having a second edge section, wherein a first portion of the first edge section of the first component is mechanically connected to a first portion of the second edge section of the second component; and a seal element on an interior side of the treatment container that seals the mechanically connected first portions of the first edge section of the first component and the second edge section of the second component on the interior side of the treatment container from exposure to moisture from within the interior of the treatment container such that a gap exposed to moisture is formed which is free of a capillary gap, wherein the mechanical connection is formed in a region of surfaces of the first component and the second component impinging substantially orthogonally on one another and wherein the seal element is arranged in a corner region of the treatment container, the corner region disposed at a wall of the treatment container joining at least one of a top of the treatment container and a tub of the household appliance, and the sealing element is at least partly surrounded by the first component and the second component in a direction remote from a rinsing chamber interior of the household appliance.

5. The household appliance as claimed in claim 4, wherein the first portion of the first edge section of the first component is mechanically connected to the first portion of the second edge section of the second component by one of a welded connection, a bonded connection, a folded connection, a clamped connection, and flanging.

6. The household appliance as claimed in claim 4, wherein the first component and the second component have different corrosion properties.

7. The household appliance as claimed in claim 4, wherein the water-conducting household appliance is a dishwasher.

* * * * *